United States Patent [19]

Kanesaka

[11] Patent Number: 4,993,637

[45] Date of Patent: Feb. 19, 1991

[54] FUEL INJECTOR

[75] Inventor: Hiroshi Kanesaka, Kawasaki, Japan

[73] Assignee: Usui Kokusai Sangyo Kaisha, Ltd., Japan

[21] Appl. No.: 409,017

[22] Filed: Sep. 18, 1989

[30] Foreign Application Priority Data

Sep. 21, 1988 [JP] Japan ..... 63-234732

[51] Int. Cl.[5] ..... F02M 41/16

[52] U.S. Cl. ..... 239/96; 239/533.4; 239/585

[58] Field of Search ..... 239/90, 533.3–533.12, 239/96

[56] References Cited

U.S. PATENT DOCUMENTS

| | | | |
|---|---|---|---|
| 3,747,857 | 7/1973 | Fenne | 239/533.5 |
| 3,777,977 | 12/1973 | Regneault | 239/533.8 |
| 3,797,753 | 3/1974 | Fenne et al. | 239/533.8 |
| 3,802,626 | 4/1974 | Regneault | 239/533.8 |
| 4,156,560 | 5/1979 | Cheklich et al. | 239/533.8 |
| 4,279,385 | 7/1981 | Straubel et al. | 239/90 |
| 4,605,166 | 8/1986 | Kelly | 239/96 |
| 4,674,688 | 6/1987 | Kanesaka | 239/96 |
| 4,741,478 | 5/1988 | Teerman et al. | 239/88 |

FOREIGN PATENT DOCUMENTS

| | | | |
|---|---|---|---|
| 206973 | 10/1985 | Japan | 239/96 |

*Primary Examiner*—Andres Kashnikow
*Assistant Examiner*—Michael J. Forman
*Attorney, Agent, or Firm*—Anthony J. Casella; Gerald E. Hespos

[57] ABSTRACT

A fuel injector includes a needle valve body which is disposed in a sliding bore provided in a valve lower part and in which a needle valve portion abuts against a valve seat in the vicinity of an injection port, an upper portion of the needle valve body being pressed downwardly by a spring; an accululator formed above the needle valve body; a fuel passage communicating with the valve seat; a communicating passage bifurcating from the fuel passage and communicating with the accumulator; and an electromagnetic regulator valve which is disposed in the communicating passage and whose opening and closing timing can be adjusted.

3 Claims, 4 Drawing Sheets

PRIOR ART

PRIOR ART

FUEL INJECTOR

BACKGROUND OF THE INVENTION

1. Field of the Invention

The present invention relates to a fuel injector for a diesel engine in which a fuel injection rate is made variable.

2. Description of the Prior Art

A generally well-known fuel injector for a diesel engine is an automatic valve, and, as shown in FIG. 3, a needle valve 103 in which a distal end needle valve portion 104 comes into contact with a valve seat 107 disposed in the vicinity of injection ports 106 is provided in a sliding bore 102 provided in a lower portion of the interior of a valve body 101, this needle valve 103 being urged downwardly by a valve spring 108 via seat 109.

Fuel oil fed under pressure from an unillustrated fuel injection pump flows into a fuel passage 110, and the needle valve 103 is subjected to pressure P of fuel oil applied to a lower end of a pressure receiving portion 105 of the needle valve 103 and thus tends to move upwardly. When the force $\pi/4\ (x^2-y^2)\cdot P$ exceeds the force pushing down the needle valve 103, the needle valve 103 moves upwardly, which in turn causes the distal end needle valve 104 to move away from the valve seat 107, causing fuel oil to be injected through the fuel ports 106.

As a result, the pressure receiving area of the needle valve 103 increases from $\pi/(x^2-y^2)$ to $\pi\times{}^2/4$, and the pressure of fuel oil is also applied to the lower surface of the needle valve 103. Consequently, the force pushing up the needle valve 103 increases, and the needle valve 103 rises sharply until an upper end 103*a* of the needle valve 103 collides against an upper end 102*a* of the sliding bore 102.

A description will be given of this operation with reference to FIG. 4 which shows four plots A to D of certain variables with respect to time. In plot A, the ordinate represents fluctuations of pressure within the fuel passage 110 resulting from the supply of fuel from a fuel injection pump into the fuel passage 110. In plot B, the ordinate represents the net force acting downwardly on the needle valve 103 resulting from the force due to the pressure within the fuel passage tending to push up the needle valve and the opposing force due to the spring 108. Similarly, ordinates of the plots C and D represent the lift of the needle valve 103 and the fuel injection rate respectively.

As described above, the pressure within the fuel passage increases from $P_0$ to $P_1$ by the supply of oil from the fuel injection pump, and this pressure is applied to the pressure receiving portion 103*a* of the needle valve 103. Since the pressure receiving area is $\pi/4(x^2-y^2)$, force $F_1$ pushing up the needle valve 103 is $P_1\cdot\pi/4(x^2-y^2)$.

Meanwhile, since the force with which the spring 108 pushes down the needle valve 103 is set to the above value $F_1$, if the pressure within the passage is higher than $P_1$, the needle valve 103 rises against downwardly pushing force $F_1$ of the spring 108. At this time, pressure $P_1$ is also applied to the lower surface of the needle valve 104, so that the force pushing up the needle valve 103 increases sharply to $F_2=P_1\cdot\pi/4(x^2-y^2)$. As a result, the upward movement of the needle valve 103 is accelerated sharply, and the lift of the needle valve 103 from the $L_0$ to $L_1$ takes place rapidly until the upper end of the needle valve 103 collides against the upper end 102*a* of the sliding bore 102. In the drawing, a time interval between $T_0$ to $T_1$ is ascribable to a delay in acceleration due to the mass of the needle valve.

The downwardly pushing force of the spring 108 increases from $F_1$ to $F_3$ owing to the lift of the needle valve 103. At this time, however, the force pushing up the needle valve 103 is greater than the downwardly pushing force $F_3$ of the spring 108, as indicated by the curved solid line in plot B of FIG. 4, so that the needle valve 103 maintains full lift.

As the injection of fuel decreases, the pressure within the passage 110 falls to $P_2$, which balances the $F_3$ with which the spring 108 pushes down the needle valve 103.

With a further decline in the pressure within the fuel passage, the needle valve 103 is pushed down by the force of the spring 108, and when the pressure falls past $P_3$ at time $T_2$, the force due to this pressure no longer overcomes the aforementioned force $F_3$, so that the needle valve 103 closes (and its lift becomes $L_0$). Accordingly, the needle valve 103 closes when the pressure in the fuel passage drops to $$P_2 = F_1/\frac{\pi x^2}{4}$$

and the needle valve 103 opens when the pressure reaches $$P_1 = F_1/\frac{\pi(x^2-y^2)}{4}.$$

Since $P_2<P_1$, the fuel injection rate is slower during valve closing than valve opening.

In actuality, the needle valve 103 being of finite mass closes not at time $T_2$ but at time $T_3$, since a delay due to its acceleration occurs. During this delay, the pressure within the fuel passage 10 drops further to $P_4$. Accordingly, the fuel injection rate which is proportional to the pressure within the fuel passage inevitably drops towards the end of the fuel injection period, as shown in plot D in FIG. 4.

In addition, after the opening of the needle valve portion 104, the injection ports 106 serve as a throttle when fuel is injected, so that it is difficult to set the port diameter. For instance, if the port diameter is set in such a manner as to display optimum performance during medium speed of the engine, the maximum pressure of fuel injection becomes excessively low at low speed in which the rate of fuel supply from the fuel injection pump is low, whereas said maximum pressure becomes excessively high at high speed.

As described above, fuel injected at a high fuel injection rate at the beginning of injection is burnt suddenly within a combustion chamber of the diesel engine and hence generates a sudden increase in pressure. This results in combustion noise due to so-called diesel knock, and also brings about a rise in combustion maximum pressure and a resultant rise in the combustion temperature, with the result that emission of harmful NOx is liable to occur.

In addition, a decline in the fuel injection rate at the end of injection, a resultant increase in the fuel injection period, and the enlargement of fuel droplets caused by a decline in the injection pressure result in the so-called after burning phenomenon. This not only results in the occurrence of harmful black smoke due to incomplete combustion and CO and hydrocarbon emission but also causes the heat efficiency to decline.

To cope with this problem, an attempt has been made to shorten the delay in acceleration by reducing the mass of the needle valve 103, but it has not led to an overall improvement in performance.

In addition, in connection with the throttling by the injection ports 106, the decline in injection pressure at low engine speed enlarges atomised fuel droplets and lowers the combustion efficiency, while, at high engine speed, the injection pressure becomes too high, which increases the stress in the fuel injection pump and results in an excessively large power absorption by the fuel injection pump. Accordingly, since resulting losses surpass the advantage of improved combustion, it follows that no overall improvement in heat efficiency can be attained.

SUMMARY OF THE INVENTION

An object of the present invention is to provide a fuel injector which can provide an enhanced fuel injection pressure at the end of the fuel injection period.

To thie end, in accordance with the present invention there is provided a fuel injector comprising a slidable needle valve member biased by biasing means against a valve seat, a fuel inlet passage which communicates with a working chamber formed around the valve seat and supplies fuel to a fuel injection port when the valve member is lifted from the valve seat, the valve member being so disposed within the working chamber that fuel pressure within the working chamber acts on a valve member surface and tends to lift the valve member from the valve seat, a fuel accumulator chamber disposed about the valve member such that fuel pressure within the fuel accumulator chamber acts on a surface of the valve member and tends to hold the valve member against a valve seat, and control valve means disposed in a further fuel passage communicating between said working chamber and accumulator chamber.

The invention also provides a fuel injection arrangement comprising a fuel injector as defined above and controlling means coupled to said control valve means and arranged to close the initially open control valve means prior to the lifting of the needle valve member from its valve seat at the beginning of the fuel injection period, and to open the control valve means prior to the seating of the valve member on its valve seat at the end of the fuel injection period.

Such an arrangement has the advantage that the fuel injection pressure is raised at the end of the fuel injection period, thereby reducing the size of the injected fuel droplets and alleviating the problem of after burning and the attendant CO and hydrocarbon emission.

Furthermore, the overall fuel injection pressure can be raised, enabling the fuel injection period to be shortened. However, the initial rate of fuel injection is reduced thereby alleviating the problem of "diesel knock" referred to above.

Preferably, said controlling means is governed by timing means, said timing means being controllable to retard or advance the opening of said control valve means so as to decrease or increase the fuel injection pressure accordingly.

Preferably means are provided for adjusting the opening or closing timing of said slidable needle valve member in relation to the opening or closing timing of said control valve means so as to adjust the opening or closing fuel injection pressure of said slidable needle valve member.

Such arrangements enable the fuel injection pressure to be optimised for various engine speeds. For example, means may be provided for retarding the timing of the slidable needle valve member at low engine speed, thereby to increase fuel injection pressure.

The above and other objects, features and advantages of the present invention will become more apparent from the following description of a preferred embodiment of the invention by way of example only when read in conjunction with the accompanying drawings.

Referring now to the accompanying drawings, a description will be given of an embodiment of the present invention.

DETAILED DESCRIPTION OF PREFERRED EMBODIMENTS

Figure 1:
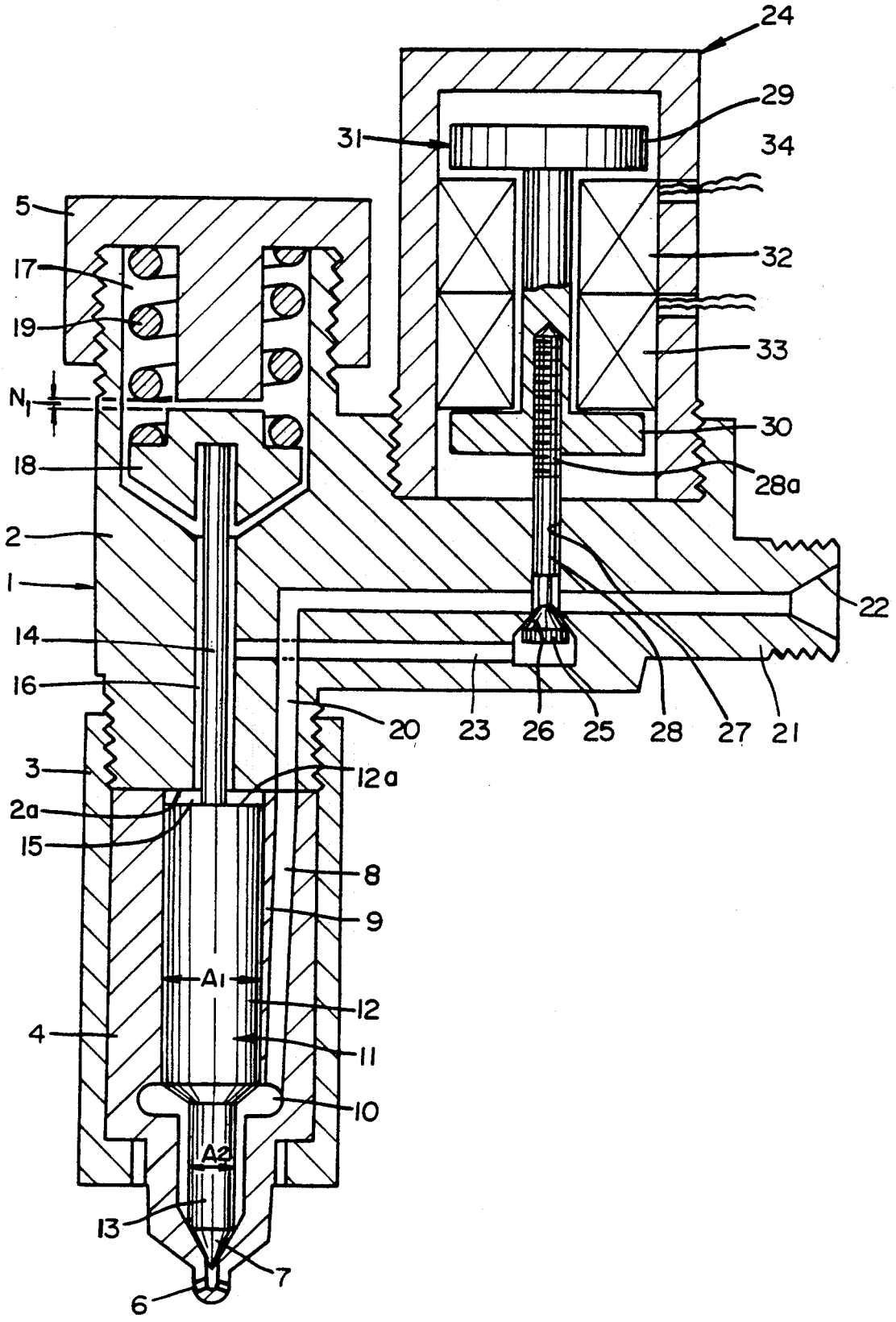
FIG. 1 is a vertical cross-sectional view of a fuel injector in accordance with the present invention.

In FIG. 1, a valve 1 of a fuel injector in accordance with the present invention comprises a valve upper part 2, a nut 3 meshing therewith, a valve lower part 4 fitted in the nut 3, and a stop 5 screwed on the valve upper part 2.

In the valve lower part 4, injection ports 5 and 6 are formed at a distal end thereof and a valve seat 7 is formed in proximity therewith. A fuel passage 8 communicating with the valve seat 7 is provided, while a sliding bore 9 inside which a needle valve 11 to be described later slides is provided in an axially central portion of the valve lower part 4. A working chamber 10 which expands horizontally is formed above the valve seat 7 in the fuel passage 8.

The needle valve 11 is arranged such that a lower needle valve portion 13 which integrally abuts against the valve seat 7 and has sectional area $A_2$ below a sliding portion 12 having sectional area $A_1$ is formed in the needle valve 11, and a pushrod 14 is provided integraly extending from the needle valve 11.

With respect to the needle valve 11, when the sliding portion 12 is fitted into the sliding bore 9 of the valve lower part 4 and the distal end of the needle valve 13 is brought into contact with the valve seat 7, an accumulator 15 is formed between an upper end **12*a* of the sliding portion 12 of the needle valve 11 and a lower end 2*a* of the valve upper part 2**.

The pushrod 14 of the needle valve 11 extends through and above a through hole 16 serving as a fuel passage and provided in the valve upper part 2, and its upper end is subjected to a downwardly pushing force by a spring 19 interposed between a spring carrier 18 and the stop 5. Spring 19 is located within a spring bore 17 provided above the valve upper part 2 and presses the needle valve 13 into contact with the valve seat 7. When the needle valve 13 opens, the upper surface **12*a* of the sliding portion 12 of the needle valve 11 and the lower surface 2*a* of the valve upper part 2 are not brought into contact with each other, and the lift of the needle valve 11 is defined by gap $N_1$ between the spring carrier 18 and the stop 5**.

A fuel passage 20 is provided in the valve upper part 2 and is arranged such that one end thereof communicates with the fuel passage 8 formed in the valve lower part 4, while the other end communicates with a communicating port 22 formed in a projection 21 of the valve upper part 2 and communicating with an (unillustrated) fuel injection pump.

A communicating passage 23 bifurcates from the fuel passage 20 in a substantially central portion of the projection 21 of the valve upper part 2 and communicates with the through hole 16.

An electromagnetic regulator valve assembly 24 comprises a regulator valve 25 abutting against a valve seat 26 formed at a branching point between the fuel passage 20 and the communicating passage 23; a sliding portion supporting the regulator valve 25 and capable of sliding within a sliding bore 27 formed above the valve seat 26; and iron armature 31 to which the sliding portion 28 is secured by a screw 28*a* formed at its upper end and has an upper portion 29 and a lower portion 30; an upper electromagnetic coil 32 and a lower electromagnetic coil 33 which are interposed between the upper armature portion 29 and the lower armature portion 30; and a case 34. The upper electromagnetic coil 32 and the lower electromagnetic coil 33 are secured in the interior of the case 34, and a lower end of the case 34 is screwed onto the projection 21.

As the lower electromagnetic coil 33 is energised, the lower armature portion 30 is lifted, which in turn causes the regulator valve 25 to be brought into pressure contact with the valve seat 26 to close the same. Similarly, as the upper electromagnetic coil 33 is energised, the upper armature portion 29 is lowered, which in turn causes the regulator valve 25 to separate from the valve seat 26, thereby opening the valve.

By virtue of the above described arrangement, (one embodiment of which is shown in FIG. 1), during the valve opening caused by a rise in the pressure within the fuel passage at the beginning of fuel injection, the fuel within an accumulator 15 is compressed by the lift of a needle valve 11 so as to increase pressure, which in turn causes the valve opening speed of the needle valve 11 to be lowered, thereby lowering the fuel injection rate. In addition, inside the combustion chamber of the engine, the heat generation rate during initial combustion is lowered and the rate of increase in combustion pressure is thereby lowered.

In addition, as the opening timing of an electromagnetic regulator valve 24 is delayed, the pressure within the accumulator 15 is increased to increase the valve opening pressure, thereby making it possible to increase the maximum pressure fuel injection.

During valve closing at the end of fuel injection, the electromagnetic regulator valve 24 is opened, and the pressure within fuel passages 20, 8 is introduced into the accumulator 15, so that the pressures above and below the needle valve member 11 become identical. Hence, the needle valve member 11 is accelerated by a spring 19 and closes. The pressure for starting the valve closing is adjusted by changing the valve opening timing of the electromagnetic regulator valve 24, and the pressure within the fuel passages at the start of the aforementioned valve closing can be adjusted in such a manner as to become higher than the pressure at the end of valve opening. As the pressure within the fuel passages at the end of the closing of the needle valve 11 is increased, the particle size of the droplets injected from the injection ports 6 at the end of fuel injection can be reduced, so that the state of combustion in the diesel engine can be improved.

In addition, as described above, the opening/closing timing of the needle valve member 11 is adjusted, the opening/closing pressure of the needle valve member 11 is increased during low engine speed, and high pressure injection is effected particularly during valve closing, the fuel injection rate is enhanced, and after burning is obviated, the amount of emissions of black smode, CO and hydrocarbons is reduced, and the isochoric degree of the Sabathel cycle can be enhanced, thereby improving the heat efficiency of the diesel engine.

The operation of the above-described embodiment will now be described in detail.

Figure 2:
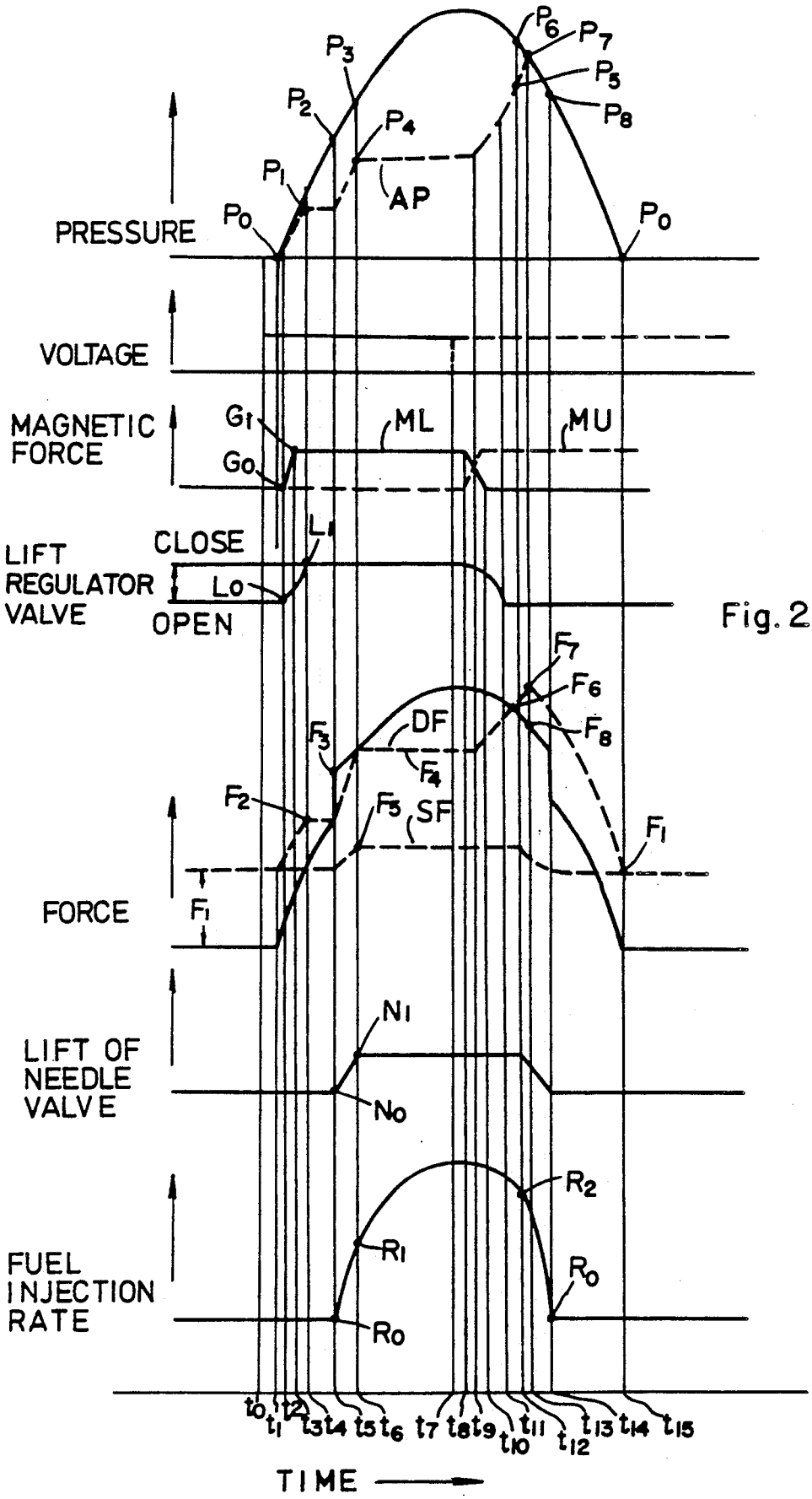
FIG. 2 is a performance curve diagram thereof.
Figure 3:
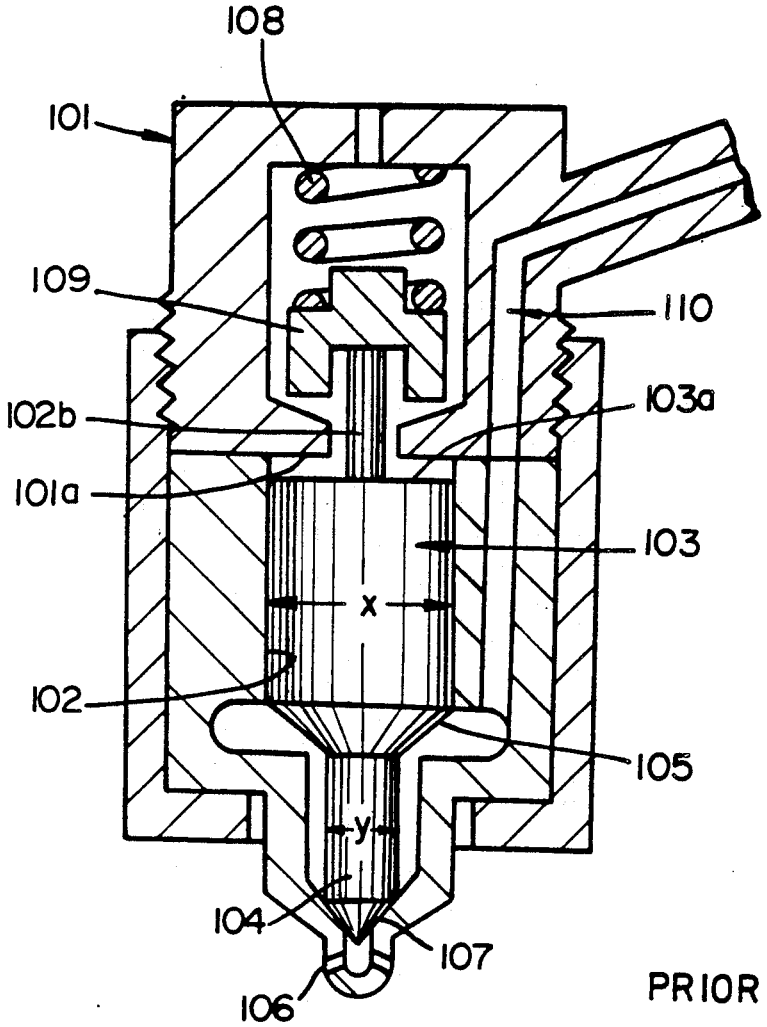
FIG. 3 is a vertical cross-sectional view of a conventional fuel injector.
Figure 4:
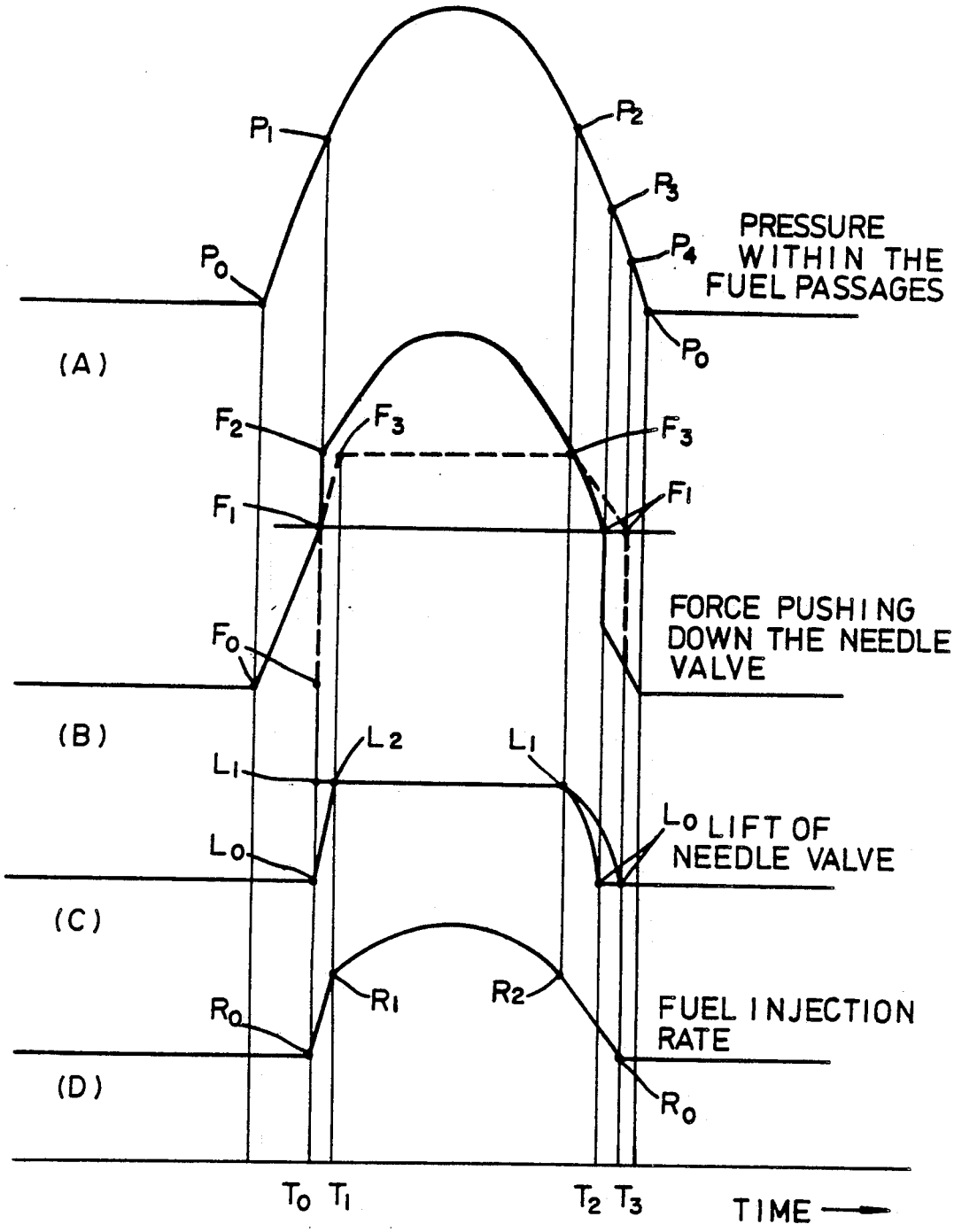
FIG. 4 is a performance curve diagram thereof.

When fuel from the fuel injection pump (not shown) flows into the fuel passages 20, 8 through the communicating port 22, since the regulator valve 25 is already located away from the valve seat 26, fuel flows into the communicating passage 23 and the through hole 16 as well, so that the pressure within the fuel passages begins to rise at time $t_1$ and pressure $P_0$ shown in FIG. 2.

At a preceding time $t_0$, a magnetic force is generated at $G_0$ in the lower electromagnetic coil 33 after a time lag of $t_0$–$t_1$ during energisation. At time $t_3$, the lower electromagnetic coil 33 exhibits its full capacity at $G_1$, and tries to pull up the lower armature portion 30. However, a time lag necessary for acceleration is caused by the mass possessed by the lower armature portion 30, upper armature portion 29, sliding portion 28 and regulator valve 25. Hence, the regulator valve 25 which was fully open with lift $L_0$ at time $t_2$ to fully closed at time $t_4$, and, in the meantime, the pressure within the accumulator 15 increases to $P_1$.

At this time, the force $F_2$ pushing down the needle valve 11 is expressed as $$F_1 = P_1 \times A_1$$

($F_1$: load at the time of mounting of the spring 19)
($A_1$: sectional area of the sliding portion 12)
Hence, since this force $F_2$ is greater than the force pushing up the needle valve 11, the latter force being expressed as $$P_1 \times (A_1 - A_2)$$

($A_2$: sectional area of the needle valve 13);
the needle valve 11 does not open.

The pressure of oil supply from the fuel injection pump rises with time, so that, at time $t_5$, the pressure within the fuel passage 8 increases to $P_2$ and the force becomes $$F_2 = F_1 - P_1 \times A_1 = P_2 \times (A_1 - A_2)$$

so that the needle valve 11 begins to fully open.

Simultaneously with valve opening, the pressure receiving area of the needle valve 11 increases from $(A_1 - A_2)$ to $A_1$, with the result that the force pushing up the needle valve 11 increases sharply to $F_3 = P_2 \times A_1$. The upward movement of the needle valve is accelerated by this force $F_3$, but a delay in acceleration occurs due to the mass of the sliding portion 12 of the needle valve 11, needle valve 13, pushrod 14, spring carrier 18, and spring 19. Accordingly, during the time interval $t_5$–$t_6$, the lift of the needle valve 11 changes from $N_0$ to $N_1$ so that the needle valve 11 opens fully, and the fuel injection rate increases from $R_0$ to $R_1$.

In the meantime, the pressure within the fuel passage 8 rises from $P_2$ to $P_3$, and the fuel in the accumulator 15 is compressed in the lift of the needle valve 11 at $N_1$, so that the accumulator pressure AP rises from $P_1$ to $P_4$ as shown by the dashed line in the first plot of FIG. 1. In consequence, the force pushing down the needle valve 11 (shown by the dashed line DF in the force:time plot of FIG. 1) rises to $F_4$, compressing the spring 19 and causing the spring load SF to increase from $F_1$ to $F_5$.

At time $t_6$ and thereafter, the fuel injection rate further increases in correspondence with the pressure of supply of oil by the fuel injection pump.

As described above, in the present invention, as time $t_0$ at which the lower electromagnetic coil 33 is energised is varied, it is possible to change fuel injection time $t_5$ and change fuel injection starting pressure $P_2$, and the fuel injection rate after that can be made variable.

Fuel injection is terminated by de-energising the lower electromagnetic coil 33 at time $t_7$ and by energising the upper electromagnetic coil 32. At time $t_8$, the magnetic force ML of the lower electromagnetic coil 33 begins to disappear, and the magnetic force MU (shown by the dashed line in the magnetic force:time plot of FIG. 1) of the upper electromagnetic coil 32 begins to be generated. At time $t_9$, the regulator valve 25 is accelerated to start opening the valve, and after $t_{10}$ the regulator valve 25 is fully opened at time $t_{11}$.

Simultaneously with the opening of the regulator valve 25, at $t_9$ the high pressure fuel in the fuel passage 20 is supplied to the accumulator 15 via the fuel passage 23 to increase the pressure.

Starting at time $t_{12}$ when pressure $P_6$ within the accumulator 15 becomes $$F_6=P_5\times A_2+F_5=P_6\times A_1$$

the needle valve 11 begins to close, but at time $t_{12}$ and thereafter the pressure within the accumulator 15 continues to rise, and at time $t_{13}$ that pressure becomes identical with $P_7$, i.e. the same as the pressure within the fuel passages 20, 8 so that the pressure becomes $$F_7=P_7\times A_1=F_5$$

Thus, the force which tries to close the needle valve 11 becomes greater by spring load $F_5$ than the force which tries to open the needle valve 11:

$$F_8=P_7\times A_1$$

As a result, the needle valve 11 is accelerated rapidly, and closes at time $t_{14}$ and pressure $P_8$ within the fuel passages 20, 8.

During the time interval $t_{12}$–$t_{14}$, the fuel injection rate decreases rapidly from $R_2$ to $R_0$, and fuel injection is completed at $R_0$. The fuel injection rate which is high at the end of fuel injection contributes to shortening the fuel injection period, enhances the efficiency of the diesel engine, and prevents the emission of black smoke from exhaust gases. At this juncture, the pressure within the fuel passages 20, 8 is high at $P_8$, the particle size of atomised droplets of fuel injected from the injection ports 6 at the end of injection is small, the combustion rate is enhanced, and the occurrence of black smoke can be controlled.

At time $t_{15}$, the pressure within the fuel passages 20, 8 again become $P_0$, and the needle valve 11 is opened by the spring 19 with force $F_1$, thereby resuming the state prior to the start of fuel injection.

As described above, in accordance with the present invention, the fuel injector comprises a needle valve body which is disposed in a sliding bore provided in a valve lower part and in which a needle valve abuts against a valve seat in the vicinity of an injection port, an upper portion of the needle valve body being pressed downwardly by a spring; an accumulator formed above the needel valve body; a fuel passage communicating with the valve seat; a communicating passage bifurcating from the fuel passage and communicating with the accumulator; and an electromagnetic regulator valve which is disposed in the communicating passage and whose opening and closing timing can be adjusted. Accordingly, as the timing of energising the electromagnetic regulator valve is changed, it is possible to change the fuel injection pressure and the fuel injection rate at the beginning of fuel injection. As the fuel injection rate is lowered, the rate of heat generation within the combustion chamber of the diesel engine can be lowered to effect combustion. In addition, it is possible to reduce the combustion noise level by lowering the rate of increase in combustion pressure, and to reduce the amount of NOx produced.

In addition, as the timing of energising the electromagnetic valve is varied, it is possible to vary the fuel injection pressure and the fuel injection rate at the end of fuel injection. At the same time, there are additional advantages in that the fuel injection period is shortened, the occurrence of after burning is controlled during combustion in the diesel engine, and it is possible to reduce the amount of emissions of black smoke, CO and hydrocarbon and enhance the heat efficiency.

Furthermore, the fuel injector in accordance with the present invention offers another advantage that as the timing of energising the electromagnetic regulator valve is varied, the initial fuel injection pressure and the final fuel injection pressure can be optimised for an optimum fuel injection rate according to the state of running of the diesel engine.

I claim:

1. A fuel injector comprising:

a valve housing having a sliding bore formed therein, a working chamber defined in the valve housing adjacent the sliding bore, a portion of the working chamber defining a valve seat, injection ports extending from the valve housing and communicating with the working chamber, a portion of the sliding bore remote from the working chamber defining a fuel accumulator, a fuel passage defined in the valve housing for delivering fuel to the working chamber, a communicating passage formed in the valve housing and extending from a location along the fuel passage and into communication with the accumulator for diverting fuel from the fuel passage to the accumulator, portions of the communicating passage adjacent said fuel passage defining a valve seat of the communicating passage;

a needle valve having a first portion disposed in the sliding bore and extending between the accumulator and the working chamber and a second portion extending from the first portion into the working chamber, said second portion being configured to selectively sealingly engage the valve seat of the working chamber, said needle valve being configured such that fuel in the working chamber urges the needle valve toward the accumulator and away from the valve seat of the working chamber, and such that fuel in the accumulator urges the needle valve toward the valve seat of the working chamber;

biasing means communicating with the needle valve for urging the needle valve toward the valve seat of the working chamber;

a regulator valve in the valve housing and moveable from a first position for sealingly engaging against the valve seat of the communicating passage to a second position spaced from the valve seat of the communicating passage;

first and second armatures connected to the regulator valve;

first and second electromagnetic actuators in proximity to the respective first and second armatures, said first and second electromagnetic actuators being selectively and alternately operable such that said first electromagnetic actuator is operable to move the first armature and the regulator valve in a first direction for sealingly engaging the valve seat of the communicating passage and such that the second electromagnetic actuator is operable to move the second armature and the regulator valve in the second direction and away from the valve seat of the communicating passage;

whereby the first and second electromagnetic actuators are alternately operable for selectively diverting fuel from the fuel passage to the accumulator for controlling fuel pressure in the accumulator and the working chamber.

2. A fuel injector as in claim 1 wherein the first electromagnetic actuator is operative to move the regulator valve into sealing engagement with the valve seat of the communicating passage when fuel pressure in the working chamber is at a level for moving the needle valve away from the valve seat of the working chamber.

3. A fuel injector as in claim 1 wherein the second electromagnetic actuator is operative to move the regulator valve away from the valve seat of the communicating passage when fuel pressure in the working chamber is at a level for permitting the biasing means to urge the needle valve toward the valve seat of the working chamber.

* * * * *